US007816308B2

(12) United States Patent
Duyck et al.

(10) Patent No.: US 7,816,308 B2
(45) Date of Patent: Oct. 19, 2010

(54) KETONE DIARYLAMINE CONDENSATES

(75) Inventors: Karl J. Duyck, Waterbury, CT (US); Theodore E. Nalesnik, Hopewell Junction, NY (US); John R. Baranski, Southington, CT (US); Cyril A. Migdal, Pleasant Valley, NY (US); Rebecca F. Seibert, Oxford, CT (US)

(73) Assignee: Crompton Corporation, Middlebury, CT (US)

( * ) Notice: Subject to any disclaimer, the term of this patent is extended or adjusted under 35 U.S.C. 154(b) by 496 days.

(21) Appl. No.: 10/825,065

(22) Filed: Apr. 14, 2004

(65) Prior Publication Data

US 2005/0230664 A1 Oct. 20, 2005

(51) Int. Cl.
*C10M 133/40* (2006.01)
*C10M 133/12* (2006.01)

(52) U.S. Cl. ..... 508/261; 508/545; 508/563; 508/583

(58) Field of Classification Search ..... 508/545, 508/261, 563, 583
See application file for complete search history.

(56) References Cited

U.S. PATENT DOCUMENTS

| | | | | | |
|---|---|---|---|---|---|
| 1,906,935 | A | | 5/1933 | Horst | |
| 1,975,167 | A | | 10/1934 | Meuser | 260/130 |
| 2,002,642 | A | | 5/1935 | Meuser et al. | 260/130 |
| 2,202,934 | A | * | 6/1940 | Tuley et al. | 528/229 |
| 2,562,802 | A | | 7/1951 | Mankowich et al. | 260/576 |
| 2,650,252 | A | | 8/1953 | Mankowich | 260/576 |
| 2,657,236 | A | | 10/1953 | Mankowich | 260/576 |
| 2,660,605 | A | | 11/1953 | Newby | 260/576 |
| 2,663,734 | A | | 12/1953 | Mankowich | 260/576 |
| 2,666,792 | A | | 1/1954 | Mankowich | 260/576 |
| 5,268,394 | A | * | 12/1993 | Wheeler et al. | 521/108 |
| 5,310,491 | A | * | 5/1994 | Downs et al. | 508/221 |
| 5,498,809 | A | * | 3/1996 | Emert et al. | 585/13 |
| RE37,101 | E | * | 3/2001 | Deetman | 252/78.5 |
| 6,315,925 | B1 | * | 11/2001 | Aebli et al. | 252/401 |

OTHER PUBLICATIONS

W. Tritschler et al., Synthese und Konformation von Spiroacridanen, Chem. Ber. 117, pp. 2703-2713, (1984).

* cited by examiner

*Primary Examiner*—Glenn Caldarola
*Assistant Examiner*—Jim Goloboy
(74) *Attorney, Agent, or Firm*—Joseph Suhadolnik

(57) ABSTRACT

Disclosed herein is a composition comprising:

A) a lubricant; and

B) a mixture of antioxidants, wherein said mixture is prepared by the partial condensation of an alkylated diphenylamine with an aldehyde or ketone in the presence of an acidic catalyst to yield at least one acridan of the general formula:

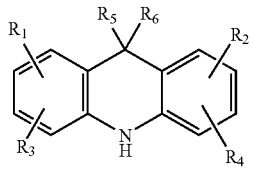

wherein:

$R_1$, $R_2$, $R_3$, and $R_4$ are independently selected from the group consisting of hydrogen, $C_3$ to $C_{32}$ alkyl, and $C_3$ to $C_{32}$ alkenyl, provided that at least one of $R_1$, $R_2$, $R_3$, and $R_4$ is not hydrogen, and $R_5$ and $R_6$ are independently selected from the group consisting of $C_1$ to $C_{20}$ hydrocarbyl and hydrogen;

wherein, at the termination of said condensation, residual alkylated diphenylamine is not separated from the acridan product.

16 Claims, No Drawings

KETONE DIARYLAMINE CONDENSATES

BACKGROUND OF THE INVENTION

1. Field of the Invention

The present invention relates to a class of lubricant additives. More particularly, the present invention relates to a class of lubricant additives that is derived from the condensation of an alkylated diphenylamine (ADPA) with a ketone or aldehyde in the presence if a suitable acidic catalyst.

2. Description of Related Art

The reaction products of a diarylamine and an aliphatic ketone are known antioxidants. Among the known diarylamine aliphatic ketone reaction products are those that are disclosed in U.S. Pat. Nos. 1,906,935; 1,975,167; 2,002,642; and 2,562,802. Briefly described, these products are obtained by reacting a diarylamine, preferably a diphenylamine, which may, if desired, possess one or more substituents on either aryl group, with an aliphatic ketone, preferably acetone, in the presence of a suitable catalyst. In addition to diphenylamine, other diarylamine reactants known in the art include dinaphthyl amines; p-nitrodiphenylamine; 2,4-dinitrodiphenylamine; p-aminodiphenylamine; p-hydroxydiphenylamine; and the like. In addition to acetone, other ketone reactants known in the art include methylethylketone, diethylketone, monochloroacetone, dichloroacetone, and the like.

A commercially available diarylamine-aliphatic ketone reaction product is one that is obtained from the condensation reaction of diphenylamine and acetone (NAUGARD A, Uniroyal Chemical) that can be prepared in accordance with the conditions described in U.S. Pat. No. 2,562,802. The commercial product is supplied as a light tan-green powder or as greenish brown flakes and has a melting range of 85° to 95° C.

A variety of factors contribute to, or have an essential bearing on, the nature of the final reaction product of ketones and secondary amines. Among such factors are the type and concentration of catalyst, the concentration and nature of the primary reactants, and the temperature level used throughout the reaction.

Several ways have long been known in the art for condensing diphenylamine and acetone to give antioxidant products ranging from solid materials (U.S. Pat. No. 2,002,642) to heavy liquids, see U.S. Pat. No. 1,975,167, which discloses an autoclavic preparation of the condensate of acetone and diphenylamine.

U.S. Pat. No. 2,202,934 discloses a process comprising passing an aliphatic ketone in vapor form into a liquified diarylamine and reacting the two materials in the presence of a catalyst and under conditions whereby a high degree of conversion of the diarylamine is obtained. The preferred catalysts are those containing halogen, e.g., iodine, bromine, hydriodic acid, hydrobromic acid, and hydrochloric acid. The temperatures employed are in the range between 100° C. and about 200° C.

U.S. Pat. No. 2,562,802 discloses a process wherein acetone and diphenylamine are autoclaved at a temperature of 275-310° C. and at a pressure greater than atmospheric, for from 3 to 10 hours, preferably in the presence of at least one catalyst such as iodine, hydriodic acid, bromine, hydrobromic acid, or the bromides and iodides of the non-lead heavy metals, especially ferrous iodide.

U.S. Pat. No. 2,650,252 discloses that the condensation of aliphatic ketones and diarylamines can be promoted by a halogenated hydrocarbon selected from the class consisting of haloalkanes, haloalkenes, halocycloalkanes, and haloalkyl benzenes, having in each case a halogen atom directly linked to a saturated carbon atom, and further the halogen in each case having an atomic weight of at least 35.

U.S. Pat. No. 2,657,236 discloses that the condensation of aliphatic ketones and diarylamines can be promoted by a catalyst selected from the class consisting of halogenated organic acids, esters of halogen-containing organic acids and amides of halogenated organic acids, in which a halogen substituent is directly linked to a saturated acyclic carbon atom.

U.S. Pat. No. 2,660,605 discloses the conversion of a relatively hard resinous aliphatic ketone-diarylamine antioxidant to a mobile oily material having a viscosity of from about 10 to about 50 poises, measured at 30° C., by heating with an alkylated benzene in which at least one alkyl group is at least two carbons in length and has at least one hydrogen on the carbon atoms alpha and beta to the benzene ring, i.e., primary and secondary alkyls.

U.S. Pat. No. 2,663,734 discloses that the condensation of aliphatic ketones and diarylamines can be promoted by a halogenated aldehyde or acetal (open chain or cyclic), the halogen having an atomic weight of at least approximately 35.

U.S. Pat. No. 2,666,792 discloses that the condensation of aliphatic ketones and diarylamines can be promoted by an acyl halide.

U.S. Pat. No. 5,268,394 discloses acridans of the structure

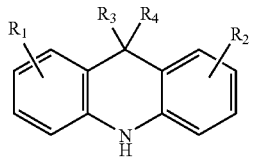

wherein $R_1$, $R_2$, $R_3$, and $R_4$ can be H, $C_1$-$C_{18}$ alkyl, or $C_7$-$C_{18}$ aralkyl. $R_3$ and $R_4$ can also be aryl, preferably phenyl. The compound can be used as a stabilizer, preferably combined with hindered amine, phenolic, and phosphite stabilizers for stabilizing polyether polyols for polyurethane flexible foams and as stabilizers for the polyglycols, heat transfer fluids, and lubricating additives.

Tritschler, W. et al., *Chem. Ber.* 117:2703-2713 (1984) reported spiroacridans of a particular formula could be easily obtained by condensation of certain diarylamines and cyclic ketones.

The disclosures of the foregoing are incorporated herein by reference in their entirety.

SUMMARY OF THE INVENTION

The present invention is directed to a class of lubricant additives that is derived from the condensation of an alkylated diphenylamine (ADPA) with a ketone or aldehyde in the presence if a suitable acidic catalyst.

More particularly, the present invention is directed to a composition comprising:

A) a lubricant; and

B) a mixture of antioxidants, wherein said mixture is prepared by the partial condensation of an alkylated diphenylamine with an aldehyde or ketone in the presence of an acidic catalyst to yield at least one acridan of the general formula:

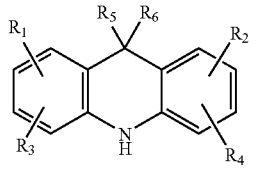

wherein:

$R_1$, $R_2$, $R_3$, and $R_4$ are independently selected from the group consisting of hydrogen, $C_3$ to $C_{32}$ alkyl, and $C_3$ to $C_{32}$ alkenyl, provided that at least one of $R_1$, $R_2$, $R_3$, and $R_4$ is not hydrogen, and $R_5$ and $R_6$ are independently selected from the group consisting of $C_1$ to $C_{20}$ hydrocarbyl, phenyl, and hydrogen;

wherein, at the termination of said condensation, residual alkylated diphenylamine is not separated from the acridan product.

In another aspect, the present invention is directed to a composition comprising:

A) a lubricant; and

B) a mixture of antioxidants comprising:

1) at least one acridan of the general formula:

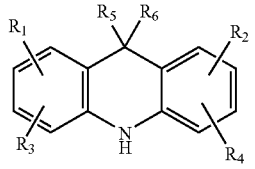

wherein:

$R_1$, $R_2$, $R_3$, and $R_4$ are independently selected from the group consisting of hydrogen, $C_3$ to $C_{32}$ alkyl, and $C_3$ to $C_{32}$ alkenyl, provided that at least one of $R_1$, $R_2$, $R_3$, and $R_4$ is not hydrogen, and $R_5$ and $R_6$ are independently selected from the group consisting of $C_1$ to $C_{20}$ hydrocarbyl and hydrogen 2) residual alkylated diphenylamine from the preparation of the acridan;

3) at least one additional antioxidant selected from the group consisting of amine antioxidants, hindered phenol antioxidants, and mixtures thereof.

In still another aspect, the present invention is directed to a method for reducing the susceptibility of a lubricant to oxidation comprising adding to said lubricant a mixture of antioxidants, wherein said mixture is prepared by the partial condensation of an alkylated diphenylamine with an aldehyde or ketone in the presence of an acidic catalyst to yield at least one acridan of the general formula:

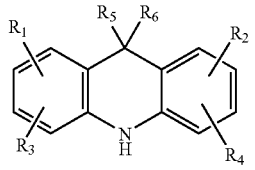

wherein:

$R_1$, $R_2$, $R_3$, and $R_4$ are independently selected from the group consisting of hydrogen, $C_3$ to $C_{32}$ alkyl, and $C_3$ to $C_{32}$ alkenyl, provided that at least one of $R_1$, $R_2$, $R_3$, and $R_4$ is not hydrogen, and $R_5$ and $R_6$ are independently selected from the group consisting of $C_1$ to $C_{20}$ hydrocarbyl and hydrogen;

wherein, at the termination of said condensation, residual alkylated diphenylamine is not separated from the acridan product.

In yet another aspect, the present invention is directed to a method for reducing the susceptibility of a lubricant to oxidation comprising adding to said lubricant a mixture of antioxidants, wherein said mixture comprises:

A) at least one acridan of the general formula:

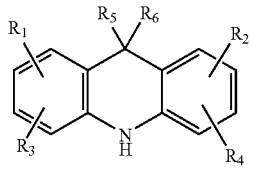

wherein:

$R_1$, $R_2$, $R_3$, and $R_4$ are independently selected from the group consisting of hydrogen, $C_3$ to $C_{32}$ alkyl, and $C_3$ to $C_{32}$ alkenyl, provided that at least one of $R_1$, $R_2$, $R_3$, and $R_4$ is not hydrogen, and $R_5$ and $R_6$ are independently selected from the group consisting of $C_1$ to $C_{20}$ hydrocarbyl and hydrogen B) residual alkylated diphenylamine from the preparation of the acridan;

C) at least one additional antioxidant selected from the group consisting of amine antioxidants, hindered phenol antioxidants, and mixtures thereof.

DESCRIPTION OF THE PREFERRED EMBODIMENTS

As noted above, the present invention relates to a class of lubricant additives that is derived from the condensation of an alkylated diphenylamine (ADPA) with a ketone or aldehyde in the presence if a suitable acidic catalyst. Compounds of this class are called acridans. They are defined by the general formula:

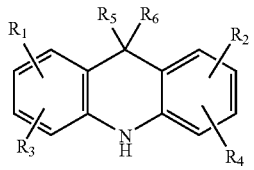

wherein:

$R_1$, $R_2$, $R_3$, and $R_4$ are independently selected from the group consisting of hydrogen, $C_3$ to $C_{32}$ alkyl, and $C_3$ to $C_{32}$ alkenyl, provided that at least one of $R_1$, $R_2$, $R_3$, and $R_4$ is not hydrogen, and $R_5$ and $R_6$ are independently selected from the group consisting of $C_1$ to $C_{20}$ hydrocarbyl and hydrogen.

Where any of $R_1$, $R_2$, $R_3$, and $R_4$ are alkyl of from 3 to 32 carbon atoms, they may be, for example, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, triacontyl, untricontyl, dotriacontyl, mixtures and isomers of the foregoing, and the like.

Preferably, where any of $R_1$, $R_2$, $R_3$, and $R_4$ are alkyl, they are alkyl of from 2 to 24 carbon atoms, more preferably from 3 to 20 carbon atoms.

Where any of $R_1$, $R_2$, $R_3$, and $R_4$ are alkenyl of from 3 to 32 carbon atoms, they may be, for example, propenyl, butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl, triacontenyl, untricontenyl, dotriacontenyl, mixtures and isomers of the foregoing, and the like.

Preferably, where any of $R_1$, $R_2$, $R_3$, and $R_4$ are alkenyl, they are alkenyl of from 2 to 24 carbon atoms, more preferably from 3 to 20 carbon atoms.

Where either or both of $R_5$ and $R_6$ are hydrocarbyl of from 1 to 20 carbon atoms, they are independently selected and may be, for example, straight or branched-chain alkyl, alkyloxy, aryl, e.g., phenyl, or heterocyclic, and may contain oxygen, nitrogen, and/or sulfur groups or linkages in addition to any carbon/hydrogen backbone.

It is known from U.S. Pat. No. 5,268,394 that acridans can be used as lubricating additives. This patent also discloses combining the acridans with certain amine stabilizers, phenolic stabilizers, and phosphite stabilizers. However, the patent also teaches only the use of acridans that have been separated from the diphenylamine employed in their manufacture. It has now been found that such separation is unnecessary and that useful combinations of acridan and residual alkylated diphenylamine can be employed as stabilizers for lubricants without the manufacturing expense of separating them from the reaction mixture. Those skilled in the art will realize that additional stabilizers can be added to the composition. In a preferred embodiment, one or more amine antioxidants, such as alkylated diphenylamines, which may be the same as or different from the residual diphenylamine of the composition, and/or hindered phenolic antioxidants are added.

The amine antioxidants can be hydrocarbon substituted diarylamines, such as, aryl, alkyl, alkaryl, and aralkyl substituted diphenylamine antioxidant materials. A nonlimiting list of commercially available hydrocarbon substituted diphenylamines includes substituted octylated, nonylated, and heptylated diphenylamines and para-substituted styrenated or α-methyl styrenated diphenylamines. The sulfur-containing hydrocarbon substituted diphenylamines, such as p-(p-toluenesulfonylamido)-diphenylamine, are also considered as part of this class.

Hydrocarbon-substituted diarylamines that are useful in the practice of this invention can be represented by the general formula Ar—NH—Ar' wherein Ar and Ar' are independently selected aryl radicals, at least one of which is preferably substituted with at least one alkyl radical. The aryl radicals can be, for example, phenyl, biphenyl, terphenyl, naphthyl, anthryl, phenanthryl, and the like. The alkyl substituent(s) can be, for example, methyl, ethyl, propyl, butyl, pentyl, hexyl, heptyl, octyl, nonyl, decyl, isomers thereof, and the like.

Preferred hydrocarbon-substituted diarylamines are those disclosed in U.S. Pat. Nos. 3,452,056 and 3,505,225, the disclosures of which are incorporated by reference herein.

Preferred hydrocarbon-substituted diarylamines can be represented by the following general formulas:

(I)

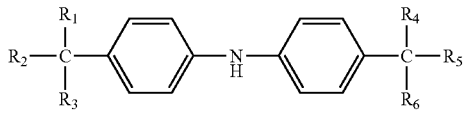

where $R_1$ is selected from the group consisting of phenyl and p-tolyl radicals;

$R_2$ and $R_3$ are independently selected from the group consisting of methyl, phenyl, and p-tolyl radicals;

$R_4$ is selected from the group consisting of methyl, phenyl, p-tolyl, and neopentyl radicals;

$R_5$ is selected from the group consisting of methyl, phenyl, p-tolyl, and 2-phenylisobutyl radicals; and, $R_6$ is a methyl radical.

(II)

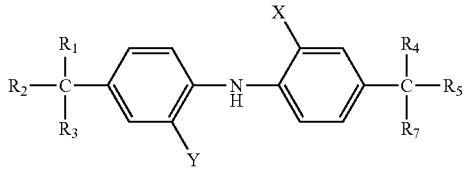

where $R_1$ through $R_5$ are independently selected from the radicals shown in Formula I and $R_7$ is selected from the group consisting of methyl, phenyl, and p-tolyl radicals;

X is a radical selected from the group consisting of methyl, ethyl, $C_3$-$C_{10}$ sec-alkyl, α,α-dimethylbenzyl, α-methylbenzyl, chlorine, bromine, carboxyl, and metal salts of the carboxylic acids where the metal is selected from the group consisting of zinc, cadmium, nickel, lead, tin, magnesium, and copper; and, Y is a radical selected from the group consisting of hydrogen, methyl, ethyl, $C_3$-$C_{10}$ sec-alkyl, chlorine, and bromine.

(III)

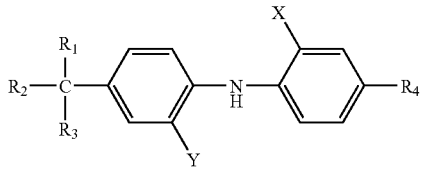

where $R_1$ is selected from the group consisting of phenyl or p-tolyl radicals;

$R_2$ and $R_3$ are independently selected from the group consisting of methyl, phenyl, and p-tolyl radicals;

$R_4$ is a radical selected from the group consisting of hydrogen, $C_3$-$C_{10}$ primary, secondary, and tertiary alkyl, and $C_3$-$C_{10}$ alkoxyl, which may be straight chain or branched; and X and Y are radicals independently selected from the group consisting hydrogen, methyl, ethyl, $C_3$-$C_{10}$ sec-alkyl, chlorine, and bromine.

(IV)

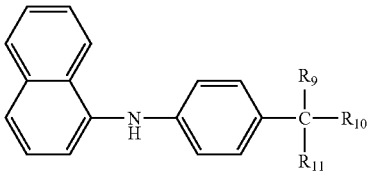

where $R_9$ is selected from the group consisting of phenyl and p-tolyl radicals;

$R_{10}$ is a radical selected from the group consisting of methyl, phenyl, p-tolyl and 2-phenyl isobutyl; and $R_{11}$ is a radical selected from the group consisting methyl, phenyl, and p-tolyl.

(V)

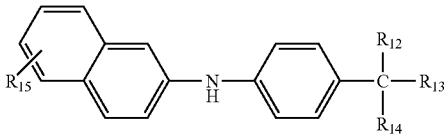

where $R_{12}$ is selected from the group consisting of phenyl or p-tolyl radicals;

$R_{13}$ is selected from the group consisting of methyl, phenyl, and p-tolyl radicals;

$R_{14}$ is selected from the group consisting of methyl, phenyl, p-tolyl, and 2-phenylisobutyl radicals; and $R_{15}$ is selected from the group consisting of hydrogen, α,α-dimethylbenzyl, α-methylbenzhydryl, triphenylmethyl, and α,α p-trimethylbenzyl radicals. Typical chemicals useful in the invention are as follows:

TYPE I

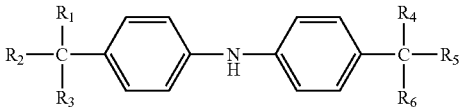

| $R_1$ | $R_2$ | $R_3$ | $R_4$ | $R_5$ | $R_6$ |
|---|---|---|---|---|---|
| Phenyl | Methyl | Methyl | Phenyl | Methyl | Methyl |
| Phenyl | Phenyl | Methyl | Phenyl | Phenyl | Methyl |
| Phenyl | Phenyl | Phenyl | Neopentyl | Methyl | Methyl |

TYPE II

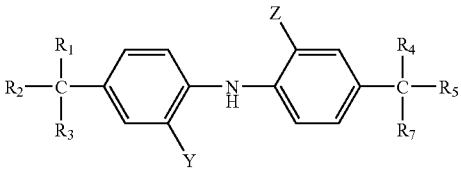

| $R_1$ | $R_2$ | $R_3$ | $R_4$ | $R_5$ | $R_7$ | Z | Y |
|---|---|---|---|---|---|---|---|
| Phenyl | Methyl | Methyl | Phenyl | Methyl | Methyl | α,α-Dimethyl-benzyl | Hydrogen |
| Phenyl | Methyl | Methyl | Phenyl | Methyl | Methyl | Bromo | Bromo |
| Phenyl | Methyl | Methyl | Phenyl | Methyl | Methyl | Carboxyl | Hydrogen |
| Phenyl | Methyl | Methyl | Phenyl | Methyl | Methyl | Nickel carboxylate | Hydrogen |
| Phenyl | Methyl | Methyl | Phenyl | Methyl | Methyl | 2-Butyl | Hydrogen |
| Phenyl | Methyl | Methyl | Phenyl | Methyl | Methyl | 2-Octyl | Hydrogen |
| Phenyl | Phenyl | Phenyl | Phenyl | Phenyl | Phenyl | 2-Hexyl | Hydrogen |

TYPE III

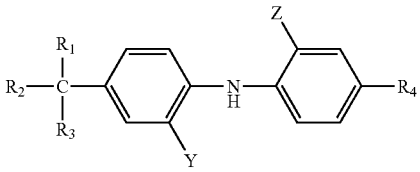

| $R_1$ | $R_2$ | $R_3$ | $R_4$ | Z | Y |
|---|---|---|---|---|---|
| Phenyl | Methyl | Methyl | Isopropoxy | Hydrogen | Hydrogen |
| Phenyl | Methyl | Methyl | Hydrogen | 2-Octyl | Hydrogen |
| Phenyl | Phenyl | Phenyl | Hydrogen | 2-Hexyl | Hydrogen |

TYPE IV

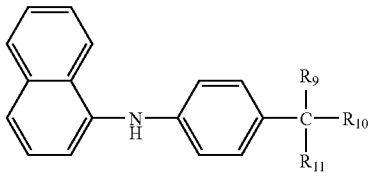

$R_9$ is phenyl and $R_{10}$ and $R_{11}$ are methyl.

A second class of amine antioxidants comprises the reaction products of a diarylamine and an aliphatic ketone. The diarylamine aliphatic ketone reaction products that are useful herein are disclosed in U.S. Pat. Nos. 1,906,935; 1,975,167; 2,002,642; and 2,562,802. Briefly described, these products are obtained by reacting a diarylamine, preferably a diphenylamine, which may, if desired, possess one or more substituents on either aryl group, with an aliphatic ketone, preferably acetone, in the presence of a suitable catalyst. In addition to diphenylamine, other suitable diarylamine reactants include dinaphthyl amines; p-nitrodiphenylamine; 2,4-dinitrodiphenylamine; p-aminodiphenylamine; p-hydroxydiphenylamine; and the like. In addition to acetone, other useful ketone reactants include methylethylketone, diethylketone, monochloroacetone, dichloroacetone, and the like.

A preferred diarylamine-aliphatic ketone reaction product is obtained from the condensation reaction of diphenylamine and acetone (NAUGARD A, Uniroyal Chemical), for example, in accordance with the conditions described in U.S. Pat. No. 2,562,802. The commercial product is supplied as a light tan-green powder or as greenish brown flakes and has a melting range of 850 to 95° C.

A third class of suitable amines comprises the N,N' hydrocarbon substituted p-phenylene diamines. The hydrocarbon substituent may be alkyl or aryl groups, which can be substituted or unsubstituted. As used herein, the term "alkyl," unless specifically described otherwise, is intended to include cycloalkyl. Representative materials are:

N-phenyl-N'-cyclohexyl-p-phenylenediamine;
N-phenyl-N'-sec.-butyl-p-phenylenediamine;
N-phenyl-N'-isopropyl-p-phenylenediamine;
N-phenyl-N'-(1,3-dimethylbutyl)-p-phenylenediamine;
N,N'-bis-(1,4-dimethylpentyl)-p-phenylenediamine;
N,N'-diphenyl-p-phenylenediamine;
mixed diaryl-p-N,N'-bis-(1-ethyl-3-methylpentyl)-p-phenylenediamine; and
N,N'-bis-(1 methylheptyl)-p-phenylenediamine.

A final class of amine antioxidants comprises materials based on quinoline, especially, polymerized 1,2-dihydro-2,2,4-trimethylquinoline. Representative materials include polymerized 2,2,4-trimethyl-1,2-dihydroquinoline; 6-dodecyl-2,2,4-trimethyl-1,2-dihydroquinoline; 6-ethoxy-2,2,4-trimethyl-1-2-dihydroquinoline, and the like.

The hindered phenols that are particularly useful in the practice of the present invention preferably are oil soluble.

Examples of useful hindered phenols include 2,4-dimethyl-6-octyl-phenol; 2,6-di-t-butyl-4-methyl phenol (i.e., butylated hydroxy toluene); 2,6-di-t-butyl-4-ethyl phenol; 2,6-di-t-butyl-4-n-butyl phenol; 2,2'-methylenebis(4-methyl-6-t-butyl phenol); 2,2'-methylenebis(4-ethyl-6-t-butyl-phenol); 2,4-dimethyl-6-t-butyl phenol; 4-hydroxymethyl-2,6-di-t-butyl phenol; n-octadecyl-beta(3,5-di-t-butyl-4-hydroxyphenyl)propionate; 2,6-dioctadecyl-4-methyl phenol; 2,4,6-trimethyl phenol; 2,4,6-triisopropyl phenol; 2,4,6-tri-t-butyl phenol; 2-t-butyl-4,6-dimethyl phenol; 2,6-methyl-4-didodecyl phenol; tris(3,5-di-t-butyl-4-hydroxy isocyanurate, and tris(2-methyl-4-hydroxy-5-t-butylphenyl) butane.

Other useful antioxidants include 3,5-di-t-butyl-4-hydroxy hydrocinnamate; octadecyl-3,5-di-t-butyl-4-hydroxy hydrocinnamate (NAUGARD 76, Uniroyal Chemical; IRGANOX 1076, Ciba-Geigy); tetrakis {methylene(3,5-di-t-butyl-4-hydroxy-hydrocinnamate)}methane (IRGANOX 1010, Ciba-Geigy); 1,2-bis(3,5-di-t-butyl-4-hydroxyhydrocinnamoyl) hydrazine (IRGANOX MD 1024, Ciba-Geigy); 1,3,5-tris(3,5-di-t-butyl-4-hydroxybenzyl)-s-triazine-2,4,6(1H,3H,5H) trione (IRGANOX 3114, Ciba-Geigy); 2,2'-oxamido bis-{ethyl-3-(3,5-di-t-butyl-4-hydroxyphenyl)}propionate (NAUGARD XL-1, Uniroyal Chemical); 1,3,5-tris(4-t-butyl-3-hydroxy-2,6-dimethylbenzyl)-s-triazine-2,4,6-(1H,3H,5H)trione (CYANOX 1790, American Cyanamid Co.); 1,3,5-trimethyl-2,4,6-tris(3,5-di-t-butyl-4-hydroxybenzyl) benzene (ETHANOX 330, Ethyl Corp.); 3,5-di-t-butyl-4-hydroxyhydrocinnamic acid triester with 1,3,5-tris(2-hydroxyethyl)-5-triazine-2,4,6(1H,3H,5H)-trione, and bis(3,3-bis(4-hydroxy-3-t-butylphenyl)butanoic acid)glycolester.

Still other hindered phenols that are useful in the practice of the present invention are polyphenols that contain three or more substituted phenol groups, such as tetrakis{methylene(3,5-di-t-butyl-4-hydroxy-hydrocinnamate)}methane (IRGANOX 1010, Ciba-Geigy) and 1,3,5-trimethyl-2,4,6-tris(3,5-di-t-butyl-4-hydroxybenzyl)benzene (ETHANOX 330, Ethyl Corp.).

Especially preferred antioxidants for use with the compositions of the present invention are mono-, di-, and tri-, nonylated diphenylamine (Naugalube® 438L), 3,5-di-t-butyl-4-hydroxy-hydrocinnamic acid $C_7$-$C_9$ branched alkyl ester (Naugalube 531), and butylated (30%) octylated (24%) diphenylamine (Naugalube 640).

The compositions of the present invention are prepared by the condensation of an alkylated diphenylamine (ADPA) with a ketone or aldehyde in the presence of a suitable acidic catalyst. It is preferred that one of the following three distinct processes be employed. The first process comprises the use of ferrous iodide and high temperatures and pressures, the second comprises the use of hydrobromic acid as a catalyst and a continuous feed of the ketone over an extended period of time, and the third comprises the use of a continuous feed of ketone and HBr catalyst over an extended period of time.

As an example of the first process, 326 grams of nonylated diphenylamine (Naugalube 438L) was charged to an autoclave along with 1.4 grams of ferrous iodide, supplied as a 40% concentrate in water, and 135 mL of acetone. The vessel was pressurized twice with nitrogen to 212 psig and vented to atmospheric pressure. It was then heated to 280° C., upon which the pressure rose to 384 psig. The reaction was allowed to continue for 6 hours during which time the pressure rose to a maximum of 518 psig. The reaction mass was then cooled, diluted with solvent and neutralized to a pH 7. The organic phase was washed with water and the organics were stripped on a rotary evaporator. The product was obtained as a dark colored viscous liquid.

As an example of the second process, nonylated diphenylamine (95 grams, Naugalube 438L) and 4.5 mL of 50% aqueous HBr were charged to a reaction vessel equipped with a mechanical stirrer, thermocouple, and electric heater. Under a nitrogen blanket, the charge was heated to 165° C. Acetone (120 mL) was added via syringe pump at a rate of 10 mL per hour. The reaction mass was then cooled and washed with dilute NaOH and stripped on a rotary evaporator. The product was obtained as a dark colored viscous liquid.

As an example of the third process, nonylated diphenylamine (40 grams, Naugalube 438L) was charged to a reaction vessel equipped with a mechanical stirrer a, thermocouple and electric heater, and an offset condenser with receiver. Under a nitrogen blanket, the charge was heated to 180° C. Acetone (62 mL) mixed with 0.875 gram of HBr (supplied as 50 wt % in water) was added via a syringe pump over about 7 hours. The reaction mass was then heat-treated for an additional hour. It was then cooled to 60° C., diluted with an equal weight of solvent (to improve washing) and washed with dilute NaOH. The organic layer was separated and stripped on a rotary evaporator. The product was obtained as a dark colored viscous liquid.

The invention may be better understood by reference to the following examples in which the parts and percentages are by weight unless otherwise indicated.

EXAMPLES

Example A

Ninety grams of butylated octylated diphenylamine and 3.6 grams of 48% aqueous hydrobromic acid were charged to a reaction vessel equipped with mechanical stirring, a nitrogen blanket, a thermocouple, an electric heater, and an offset condenser with receiver. This was heated to 180° C. Utilizing an HPLC pump, 340 mL of acetone was added to the reaction mass over about 6.5 hours. The reaction mass was then heat-treated for an additional 30 minutes. The reaction mass was then cooled to 70° C., diluted with 250 mL of heptane (to improve washing) and washed with dilute NaOH. The organic layer was separated and allowed to stand overnight. The resultant precipitate (designated hereinafter as AC1) was filtered off to afford 7.2 grams of a white-gray needle-like solid with a melting point of 229-231° C. Analysis showed this to be di-tert-butyl dimethylacridan. $^1$H NMR: δ=1.303 ppm Integral=18 (t-butyl); δ=1.591 ppm Integral=6 ($Ar_2$—C—$(CH_3)_2$); δ=6.002 ppm Integral=1 (—N—H); δ=6.592, 6.619, 7.084, 7.090, 7.112, 7.117, and 7.387 ppm Integral=6 (aromatic). $^{13}$C NMR: δ=30.661 ppm Integral=2 ($Ar_2C(CH_3)_2$); δ=31.618 ppm Integral=6 ($ArC(CH_3)_3$); δ=34.299 ppm Integral=2 ($ArC(CH_3)_3$); δ=36.619 ppm Integral=1 ($Ar_2C(CH_3)_2$); δ=112.837, 122.156, 123.477, 128.504, 136.376, 142.917 ppm Integral=12 aromatic.

Oxidation Test

Pressure Differential Scanning Calorimetry Test

The antioxidant properties of the reaction products of the present invention were determined in the Pressure Differential Scanning Calorimetry (PDSC) Test. Testing was performed using a Mettler-Toledo DSC27HP, following outlined procedures. This test measures the relative Oxidation Induction Time (OIT) of antioxidants in lubricating fluids as measured in $O_2$ gas under pressure.

All samples were blended at 0.4% by weight of total antioxidant into a model fully-formulated motor oil (see Table 1) that did not contain primary antioxidants. An additional 0.1 wt % of Solvent Neutral 150 base oil was then added along with 50 ppm ferric naphthenate. The results were compared to those of a baseline sample of the base blend containing 0.5 wt. % of Solvent Neutral 150 base oil and 50 ppm of ferric naphthenate. The conditions of the PDSC test are shown in Table 2. Table 3 shows additive concentrations and test results for combinations of nonylated diphenylamine (Naugalube 438L) and AC1. Table 4 shows additive concentrations and test results for combinations of hindered phenolic antioxidant (Naugalube 531) nonylated diphenylamine (Naugalube 438L) and AC1. The numerical value of the tests results is measured as oxidation induction time (OIT) in minutes, and increases with an increase in effectiveness.

TABLE 1

Base Blend for PDSC test

| Component | wt. % |
|---|---|
| Solvent Neutral 150 | 83.85 |
| Zinc dialkyldithiophosphate | 1.01 |
| Antioxidant | 0.0 |
| Succinimide Dispersant | 7.58 |
| Overbased Calcium Sulfonate Detergent | 1.31 |
| Neutral Calcium Sulfonate Detergent | 0.5 |
| Rust Inhibitor | 0.1 |
| Pour Point Depressant | 0.1 |
| OCP VI Improver | 5.55 |

TABLE 2

PDSC conditions

| Conditions | Setting |
|---|---|
| Temperature | 200° C. |
| Gas | Oxygen |
| Flow Rate | 100 mL/min |
| Pressure | 500 psi |
| Sample Size | 1-5 mg |
| Pan (open/closed) | open |

TABLE 3

Additive Concentrations And Test Results For Combinations Of Nonylated Diphenylamine (Naugalube 438L) and AC1

| | Antioxidant Combination | | |
|---|---|---|---|
| Example | Naugalube 438L | AC1 | OIT (Minutes) |
| 1 | 0.4 | 0.0 | 18.3 |
| 2 | 0.3 | 0.1 | 21.3 |
| 3 | 0.2 | 0.2 | 21.25 |
| 4 | 0.1 | 0.3 | 17.56 |
| 5 | 0.0 | 0.4 | 17.5 |
| Baseline | 0.0 | 0.0 | 5.45 |

TABLE 4

Additive Concentrations And Test Results For Combinations Of Hindered Phenolic Antioxidant (Naugalube 531) Nonylated Diphenylamine (Naugalube 438L) and AC1

| | Antioxidant Combination | | | |
|---|---|---|---|---|
| Example | Naugalube 531 | Naugalube 438L | AC1 | OIT (Minutes) |
| 6 | 0.4 | 0.0 | 0.0 | 6.37 |
| 7 | 0.0 | 0.2 | 0.0 | 11.90 |
| 8 | 0.2 | 0.2 | 0.0 | 13081 |
| 9 | 0.2 | 0.15 | 0.05 | 20.75 |
| 10 | 0.2 | 0.1 | 0.1 | 18.95 |
| 11 | 0.2 | 0.05 | 0.15 | 17.31 |
| 12 | 0.2 | 0.0 | 0.2 | 18.25 |
| Baseline | 0.0 | 0.0 | 0.0 | 5.45 |

As can be seen in Tables 3 and 4, the combination of alkylated diphenylamine and alkylated dimethylacridan performs synergistically to improve the performance of the lubricant formulation over the performance of either additive alone. Further, the replacement of a portion of alkylated diphenylamine with alkylated dimethylacridan, when employed in combination with a phenolic antioxidant, generates performance superior to that of either alkylated diphenylamine or alkylated dimethylacridan alone in combination with a phenolic antioxidant, especially when the alkylated dimethylacridan is used in about a 1:3 ratio with alkylated diphenylamine.

Preparing Blends of Alkylated Dimethylacridans and Alkylated Diphenylamines

Instead of preparing a pure sample of alkylated acridan and physically blending it with an alkylated diphenylamine either in a lubricating fluid or prior to blending into a lubricating fluid, it is possible and in accordance with the present invention to manufacture the desired ratio of alkylated acridan to alkylated diphenylamine by first intent. The following are examples of this method.

Additive A 40 grams of nonylated diphenylamine (Naugalube 438L) was charged to a reaction vessel equipped with mechanical stirring a, nitrogen blanket, a thermocouple, an electric heater, and an offset condenser with receiver. This was heated to 180° C. Sixty-two mL of acetone mixed with 0.875 gram of HBr (supplied as 50 wt % in water) was added via syringe pump over about 7 hours. The reaction mass was then heat-treated for an additional hour. The reaction mass was then cooled to 60° C., diluted with an equal weight of solvent (to improve washing) and washed with dilute NaOH. The organic layer was separated and stripped on a rotary evaporator. The product was obtained as a dark colored viscous liquid. Analysis by GC (Gas Chromatography) indicated that 42.8% RA (relative area) was new alkylated material with the remainder being starting material.

Additive B

Forty-five grams of butylated octylated diphenylamine (Naugalube 640) was charged to a reaction vessel equipped with mechanical stirring, a nitrogen blanket, a thermocouple, an electric heater, and an offset condenser with receiver. This was heated to 180° C. Acetone (63 mL) mixed with 0.9 gram of HBr (supplied as 50 wt % in water) was added via syringe pump over about 3.5 hours. The reaction mass was then heat-treated for an additional 3 hours. The reaction mass was then cooled to 70° C., diluted with an equal weight of solvent (to improve washing) and washed with dilute NaOH. The organic layer was separated and stripped on a rotary evaporator. The product was obtained as a dark colored viscous liquid. Analysis by GCMS (Gas Chromatography/Mass Spectroscopy) indicated that 34.1% RA was dimethylacridan with various numbers and lengths of alkyl groups with the remainder being starting material.

Additive C

A quantity of 43.1 grams of nonylated diphenylamine (Naugalube 438L) was charged to a reaction vessel equipped with mechanical stirring a, nitrogen blanket, a thermocouple, an electric heater, and a condenser. This was heated to 180° C. A stock solution of 52.5 mL of acetone mixed with 1.8 grams of HBr (supplied as 50 wt % in water) was prepared. Of this, 7 mL was added over 1 hour. The reaction mass was then heat-treated for an additional 6 hours. The product was obtained as a dark colored viscous liquid. Analysis by GC indicated that 23% RA was new alkylated material with the remainder being starting material.

Oxidation Test

Oxidation Stability of Steam Turbine Oils by Rotating Bomb

The antioxidant properties of the reaction products of the present invention were determined in the Rotating Bomb Oxidation Test (RBOT). Testing was performed following ASTM D 2272, in a Koehler Instrument Company, Inc. Rotary Bomb Oxidation Bath (model K-70200) fitted with a Koehler model K-70502 pressure measurement system. This test measures the relative Oxidation Induction Time (OIT) of antioxidants in lubricating fluids as measured by the drop in pressure of a vessel pressurized with $O_2$ gas.

Each sample to be tested was formulated into a model steam-turbine oil (see Table 5) that did not contain antioxidant, at 0.5% by weight. These were then compared to a sample of the base blend containing an additional 0.5 wt. % of Excel 100 base oil. Table 6 provides the numerical value of the test results (OIT, minutes) where an increase in numerical value translates to an increase in effectiveness.

TABLE 5

Formulation for RBOT

| Component | Weight Percent |
|---|---|
| Excel 100 | 99.3 |
| Metal Deactivator | 0.1 |
| Corrosion Inhibitor | 0.1 |
| Additive | 0.5 |

TABLE 6

RBOT Results

| Example | Additive | OIT |
|---|---|---|
| Blank | No Additive | 37 |
| 13 | Additive A | 910 |
| 14 | Additive B | 1532 |
| Reference A | Naugalube 438 L | 670 |
| Reference B | Naugalube 640 | 1435 |

Oxidation Test

Pressure Differential Scanning Calorimetry (PDSC) Test

A PDSC test was carried out employing the protocol described above. Table 7 shows additive concentrations and test results for combinations of alkylated diphenylamine (Naugalube 438L or Naugalube 640) and the prepared examples. Table 8 shows additive concentrations and test results for combinations of hindered phenolic antioxidant (Naugalube 531), alkylated diphenylamine, and the prepared examples. The numerical value of the tests results is measured as oxidation induction time (OIT) in minutes, and increases with an increase in effectiveness.

TABLE 7

Additive Concentrations And Test Results For Combinations Of Alkylated Diphenylamine and Additives A-C

| | Antioxidant Combination | | | | | |
|---|---|---|---|---|---|---|
| Example | Naugalube 438 L | Naugalube 640 | Additive A | Additive B | Additive C | OIT (Minutes) |
| 1 | 0.4 | 0.0 | 0.0 | 0.0 | 0.0 | 18.3 |
| 15 | 0.0 | 0.4 | 0.0 | 0.0 | 0.0 | 19.66 |
| 16 | 0.0 | 0.0 | 0.4 | 0.0 | 0.0 | 20.27 |
| 17 | 0.0 | 0.0 | 0.0 | 0.4 | 0.0 | 21.09 |
| 18 | 0.0 | 0.0 | 0.0 | 0.0 | 0.4 | 21.11 |

TABLE 7-continued

| Additive Concentrations And Test Results For Combinations Of Alkylated Diphenylamine and Additives A-C | | | | | | |
|---|---|---|---|---|---|---|
| | Antioxidant Combination | | | | | |
| Example | Naugalube 438 L | Naugalube 640 | Additive A | Additive B | Additive C | OIT (Minutes) |
| 19 | 0.0 | 0.107 | 0.0 | 0.293 | 0.0 | 20.9 |
| Baseline | 0.0 | 0.0 | 0.0 | 0.0 | 0.0 | 5.45 |

TABLE 8

| Additive Concentrations And Test Results For Combinations Of Hindered Phenolic Antioxidant (Naugalube 531) Alkylated Diphenylamine and additives A-C | | | | | | | |
|---|---|---|---|---|---|---|---|
| | Antioxidant Combination | | | | | | |
| Example | Naugalube 531 | Naugalube 438 L | Naugalube 640 | Additive A | Additive B | Additive C | OIT (Minutes) |
| 8 | 0.2 | 0.2 | 0.0 | 0.0 | 0.0 | 0.0 | 13.81 |
| 20 | 0.2 | 0.0 | 0.2 | 0.0 | 0.0 | 0.0 | 14.78 |
| 21 | 0.2 | 0.0 | 0.0 | 0.2 | 0.0 | 0.0 | 17.80 |
| 22 | 0.2 | 0.0 | 0.0 | 0.0 | 0.2 | 0.0 | 19.73 |
| 23 | 0.2 | 0.0 | 0.0 | 0.0 | 0.0 | 0.2 | 16.60 |
| 24 | 0.2 | 0.0 | 0.053 | 0.0 | 0.147 | 0.0 | 17.58 |
| Baseline | 0.0 | 0.0 | 0.0 | 0.0 | 0.0 | 0.0 | 5.45 |

As can be seen in comparison to Examples 1 and 15, performance in this test is improved by the additive examples that were prepared as a mixture of alkylated diphenylamine and alkylated acridan. When used in combination with a phenolic antioxidant as well, the performance of these additives becomes even greater. While the combination of phenolic antioxidant and alkylated diphenylamine produces OITs in the range of 13-15 minutes, utilizing the synergy between the three additives in this invention can boost the oxidation induction time to nearly 20 minutes as in example 22.

In view of the many changes and modifications that can be made without departing from principles underlying the invention, reference should be made to the appended claims for an understanding of the scope of the protection to be afforded the invention.

What is claimed is:

1. A composition comprising:

A) a lubricant; and

B) a mixture of antioxidants, wherein said mixture is prepared by the partial condensation of an alkylated diphenylamine comprising a tri-nonylated diphenylamine with an aldehyde or ketone in the presence of an acidic catalyst to yield at least one acridan of the general formula:

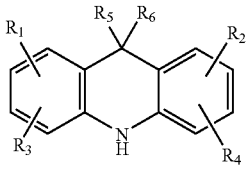

along with residual alkylated diphenylamine remaining after said partial condensation;

wherein:

$R_1$, $R_2$, $R_3$, and $R_4$ are independently selected from the group consisting of hydrogen and nonyl, provided that at least three of $R_1$, $R_2$, $R_3$, and $R_4$ are not hydrogen, and $R_4$, and $R_5$ are independently selected from the group consisting of $C_1$ to $C_{20}$ hydrocarbyl and hydrogen; wherein, at the termination of said condensation, residual alkylated diphenylamine is not separated from the acridan product and remains in said mixture with said antioxidants.

2. The composition of claim 1 wherein the alkylated diphenylamine is condensed with a ketone.

3. The composition of claim 2 wherein the ketone is acetone.

4. The composition of claim 1 wherein the composition further comprises at least one antioxidant in addition to that provided by the mixture of acridan and residual alkylated diphenylamine.

5. The composition of claim 4 wherein the additional antioxidant is selected from the group consisting of amine antioxidants, hindered phenol antioxidants, and mixtures thereof.

6. The composition of claim 5 wherein the hindered phenol antioxidant is selected from the group consisting of 2,4-dimethyl-6-octyl-phenol; 2,6-di-t-butyl-4-methyl phenol; 2,6-di-t-butyl-4-ethyl phenol; 2,6-di-t-butyl-4-n-butyl phenol; 2,2'-methylenebis(4-methyl-6-t-butyl phenol); 2,2'-methylenebis (4-ethyl-6-t-butyl-phenol); 2,4-dimethyl-6-t-butyl phenol; 4-hydroxymethyl-2,6-di-t-butyl phenol; n-octadecyl-beta(3,5-di-t-butyl-4-hydroxyphenyl)propionate; 2,6-dioctadecyl-4-methyl phenol; 2,4,6-trimethyl phenol; 2,4,6-triisopropyl phenol; 2,4,6-tri-t-butyl phenol; 2-t-butyl-4,6-dimethyl phenol; 2,6-methyl-4didodecyl phenol; tris(3,5-di-t-butyl-4-hydroxy isocyanurate; tris(2-methyl-4-hydroxy-5-t-butylphenyl)butane; 3,5-di-t-butyl-4-hydroxy hydrocinnamate; octadecyl-3,5-di-t-butyl-4-hydroxy hydrocinnamate; tetrakis{methylene(3,5-di-t-butyl-4-hydroxyhydrocinnamate)}methane; 1,2-bis(3,5-di-t-butyl-4-hydroxyhydrocinnamoyl)hydrazine; 1,3,5-tris(3,5-di-t-butyl-4-hydroxybenzyl)-s-triazine-2,4,6(1H,3H,5H)trione; 2,2'-oxamido bis-{ethyl-3-(3,5-di-t-butyl-4-hydroxyphen-yl)}propionate; 1,3,5-tris(4-t-butyl-3-hydroxy-2,6-dimethylbenzyl)-s-triaz-ine-2,4,6-(1H,3H,5H)trione; 1,3,5-trimethyl-2,4,6-tris(3,5-di-t-butyl-4-hy-droxybenzyl)benzene; 3,5-di-t-butyl-4-hydroxyhydrocinnamic acid triester with 1,3,5-tris(2-hydroxyethyl)-5-triazine-2,4,6(1H,3H,5H)-trione; bis(3,3-bis(4-hydroxy-3-t-butylphenyl)butanoic acid)glycolester; tetrakis{methylene (3,5-di-t-butyl-4-hydroxyhydrocinnamate)}methane; 1,3,5-trimethyl-2,4,6-tris(3,5-di-t-butyl-4-hydroxybenzyl)benzene; and 3,5-di-t-butyl-4-hydroxy-hydrocinnamic acid $C_7$-$C_9$ branched alkyl ester.

7. A method for reducing the susceptibility of a lubricant to oxidation comprising adding to said lubricant a mixture of antioxidants, wherein said mixture is prepared by the partial condensation of an alkylated diphenylamine with an aldehyde or ketone in the presence of an acidic catalyst to yield at least one acridan of the general formula:

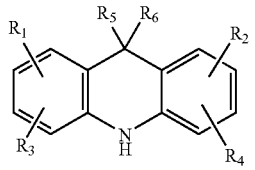

along with residual alkylated diphenylamine remaining after said partial condensation;

wherein:

$R_1$, $R_2$, $R_3$, and $R_4$ are independently selected from the group consisting of hydrogen and nonyl, provided that at least three of $R_1$, $R_2$, $R_3$, and $R_4$ are not hydrogen, and $R_4$, and $R_5$ are independently selected from the group consisting of $C_1$ to $C_{20}$ hydrocarbyl and hydrogen; wherein, at the termination of said condensation, residual alkylated diphenylamine is not separated from the acridan product and remains in said mixture with said antioxidants.

8. The method of claim 7 wherein the alkylated diphenylamine comprises mono-, di-, and tri-nonylated diphenylamine.

9. The method of claim 7 wherein the alkylated diphenylamine is condensed with a ketone.

10. The method of claim 9 wherein the ketone is acetone.

11. The method of claim 8 wherein the alkylated diphenylamine is condensed with a ketone.

12. The method of claim 11 wherein the ketone is acetone.

13. The method of claim 7 wherein the composition further comprises at least one antioxidant in addition to that provided by the mixture.

14. The method of claim 13 wherein the additional antioxidant is selected from the group consisting of amine antioxidants, hindered phenol antioxidants, and mixtures thereof.

15. The method of claim 14 wherein the hindered phenol antioxidant is selected from the group consisting of 2,4-dimethyl-6-octyl-phenol; 2,6-di-t-butyl-4-methyl phenol; 2,6-di-t-butyl-4-ethyl phenol; 2,6-di-t-butyl-4-n-butyl phenol; 2,2'-methylenebis(4-methyl-6-t-butyl phenol); 2,2'-methylenebis(4-ethyl-6-t-butyl-phenol); 2,4-dimethyl-6-t-butyl phenol; 4-hydroxymethyl-2,6-di-t-butyl phenol; n-octadecyl-beta(3,5-di-t-butyl-4-hydroxyphenyl)propionate; 2,6-dioctadecyl-4-methyl phenol; 2,4,6-trimethyl phenol; 2,4,6-triisopropyl phenol; 2,4,6-tri-t-butyl phenol; 2-t-butyl-4,6-dimethyl phenol; 2,6-methyl-4-didodecyl phenol; tris(3,5-di-t-butyl-4-hydroxy isocyanurate; tris(2-methyl-4-hydroxy-5-t-butylphenyl)butane; 3,5-di-t-butyl-4-hydroxy hydrocinnamate; octadecyl-3,5-di-t-butyl-4-hydroxy hydrocinnamate; tetrakis{methylene(3,5-di-t-butyl-4-hydroxyhydrocinnamate)}methane; 1,2-bis(3,5-di-t-butyl-4-hydroxyhydrocinnamoyl)hydrazine; 1,3,5-tris(3,5-di-t-butyl-4-hydroxybenzyl)-s-triazine-2,4,6(1H,3H,5H)trione; 2,2'-oxamido bis-{ethyl-3-(3,5-di-t-butyl-4-hydroxyphen-yl)}propionate; 1,3,5-tris(4-t-butyl-3-hydroxy-2,6-dimethylbenzyl)-s-triaz-ine-2,4,6-(1H,3H,5H)trione; 1,3,5-trimethyl-2,4,6-tris(3,5-di-t-butyl-4-hy-droxybenzyl)benzene; 3,5-di-t-butyl-4-hydroxyhydrocinnamic acid triester with 1,3,5-tris(2-hydroxyethyl)-5-triazine-2,4,6(1H,3H,5H)-trione; bis(3,3-bis(4-hydroxy-3-t-butylphenyl)butanoic acid)glycolester; tetrakis{methylene(3,5-di-t-butyl-4-hydroxyhydrocinnamate)}methane; 1,3,5-trimethyl-2,4,6-tris(3,5-di-t-butyl-4-hydroxybenzyl)benzene; and 3,5-di-t-butyl-4-hydroxy-hydrocinnamic acid $C_7$-$C_9$ branched alkyl ester.

16. A composition according to claim 1 comprising:

A) a lubricant; and

B) a mixture of antioxidants, wherein said mixture is prepared by the partial condensation of an alkylated diphenylamine comprising mono-, di-, and tri-nonylated diphenylamine with an aldehyde or ketone in the presence of an acidic catalyst to yield at least one acridan of the general formula:

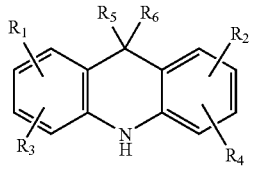

along with residual alkylated diphenylamine remaining after said partial condensation;

wherein:

$R_1$, $R_2$, $R_3$, and $R_4$ are independently selected from the group consisting of hydrogen and nonyl, provided that at least three of is $R_1$, $R_2$, $R_3$, and $R_4$ not hydrogen, and $R_4$, and $R_5$ are independently selected from the group consisting of $C_1$ to $C_{20}$ hydrocarbyl and hydrogen; wherein, at the termination of said condensation, residual alkylated diphenylamine is not separated from the acridan product and remains in said mixture with said antioxidants.

* * * * *